US010189067B2

(12) United States Patent
Rogers

(10) Patent No.: US 10,189,067 B2
(45) Date of Patent: Jan. 29, 2019

(54) TOOL HOLDERS USABLE WITH TOOLING HAVING DIFFERENT TANG STYLES AND/OR CONFIGURED WITH MECHANICALLY-ACTUATED CLAMP ASSEMBLY

(71) Applicant: Wilson Tool International Inc., White Bear Lake, MN (US)

(72) Inventor: Bryan L. Rogers, Forest Lake, MN (US)

(73) Assignee: Wilson Tool International Inc., White Bear Lake, MN (US)

( * ) Notice: Subject to any disclaimer, the term of this patent is extended or adjusted under 35 U.S.C. 154(b) by 812 days.

(21) Appl. No.: 14/723,249

(22) Filed: May 27, 2015

(65) Prior Publication Data

US 2016/0346823 A1 Dec. 1, 2016

(51) Int. Cl.

| | |
|---|---|
| ***B21D 37/04*** | (2006.01) |
| ***B21D 5/02*** | (2006.01) |
| ***B21D 37/14*** | (2006.01) |

(52) U.S. Cl.

CPC ..... *B21D 5/0236* (2013.01); *B21D 37/04* (2013.01); *B21D 37/14* (2013.01)

(58) Field of Classification Search

CPC ..... B21D 5/0236; B21D 37/04; B21D 37/14
USPC ..... 72/481.2, 481.1, 481.6
See application file for complete search history.

(56) References Cited

U.S. PATENT DOCUMENTS

| | | | |
|---|---|---|---|
| 851,350 | A | 4/1907 | Frey |
| 4,315,425 | A | 2/1982 | Zbornik et al. |
| 4,534,203 | A | 8/1985 | Cros |
| 5,121,626 | A | 6/1992 | Baldwin |
| 5,390,527 | A | 2/1995 | Kawano |
| 5,511,407 | A | 4/1996 | Kawano |
| 5,513,514 | A | 5/1996 | Kawano |
| 5,572,902 | A | 11/1996 | Kawano |
| 5,619,885 | A | 4/1997 | Kawano et al. |
| 5,642,642 | A | 7/1997 | Kawano |
| 5,685,191 | A | 11/1997 | Kawano et al. |
| 5,782,308 | A | 7/1998 | Latten et al. |
| 5,794,486 | A | 8/1998 | Sugimoto et al. |

(Continued)

FOREIGN PATENT DOCUMENTS

| | | | |
|---|---|---|---|
| CN | 203236230 | U | 10/2013 |
| DE | 3932629 | A1 | 4/1990 |

(Continued)

OTHER PUBLICATIONS

International Patent Application No. PCT/US2016/034030, International Search Report and Written Opinion dated Jul. 19, 2016, 11 pages.

*Primary Examiner* — David B Jones
(74) *Attorney, Agent, or Firm* — Fredrikson & Byron, P.A.

(57) ABSTRACT

Tool holder designs are described. In some cases, the tool holder has a clamp assembly that can be used with tools having different tang styles. The tool holder in some cases has at least two differing tolerance areas provided therein, wherein the tolerance areas provide complementary tolerance to the design. In some cases, the tool holder can have a mechanically actuatable mechanism that functions with one or more internal components that limit adjustment of the mechanism to prevent damage to one or more of tool and the tool holder when securing the tool therein.

32 Claims, 7 Drawing Sheets

(56) References Cited

U.S. PATENT DOCUMENTS

| | | | | |
|---|---|---|---|---|
| 6,003,360 | A * | 12/1999 | Runk | B21D 5/0236 72/389.3 |
| 6,138,492 | A | 10/2000 | Vining et al. | |
| 6,151,951 | A | 11/2000 | Kawano et al. | |
| 6,446,485 | B1 | 9/2002 | Tarasconi | |
| 6,606,896 | B2 | 8/2003 | Tarasconi | |
| 6,644,090 | B2 | 11/2003 | Gasparini | |
| 7,069,766 | B2 | 7/2006 | Hayashi et al. | |
| 7,096,708 | B2 | 8/2006 | Gascoin | |
| 7,296,457 | B2 | 11/2007 | Morehead et al. | |
| 7,308,817 | B2 * | 12/2007 | Shimota | B21D 5/0209 72/481.1 |
| 7,343,774 | B2 | 3/2008 | Gascoin et al. | |
| 7,596,983 | B2 * | 10/2009 | Pabich | B29C 47/128 72/481.1 |
| 7,721,586 | B2 | 5/2010 | Pabich et al. | |
| 8,496,255 | B2 | 7/2013 | Rouweler | |
| 2002/0023477 | A1 | 2/2002 | Gianelli | |
| 2005/0178183 | A1 | 8/2005 | Johnson et al. | |

FOREIGN PATENT DOCUMENTS

| | | | |
|---|---|---|---|
| EP | 1449599 | A1 | 8/2004 |
| JP | H06-23436 | A | 2/1994 |
| WO | 0139906 | A1 | 6/2001 |
| WO | 2012145781 | A1 | 11/2012 |

* cited by examiner

TOOL HOLDERS USABLE WITH TOOLING HAVING DIFFERENT TANG STYLES AND/OR CONFIGURED WITH MECHANICALLY-ACTUATED CLAMP ASSEMBLY

FIELD OF THE INVENTION

The present invention relates generally to tool holders for use with industrial machines or equipment. More particularly, this invention relates to tool holders usable on press brakes, and assemblies of such tool holders for securing tools therewith.

BACKGROUND

Sheet metal and other workpieces can be fabricated into a wide range of useful products. The fabrication (i.e., manufacturing) processes commonly employed involve bending, folding, and/or forming holes in the sheet metal and other workpieces. The equipment used for such processes involve many types, including turret presses and other industrial presses (such as single-station presses), Trumpf style machines and other rail type systems, press brakes, sheet feed systems, coil feed systems, and other types of fabrication equipment adapted for punching or pressing sheet materials.

Concerning press brakes, they are equipped with a lower table and an upper table, and are commonly used for deforming metal workpieces. One of the tables (typically the upper table) is configured to be vertically movable toward the other table. Forming tools are mounted to the tables so that when one table is brought toward the other, a workpiece positioned there between can be formed, e.g., bent into an appropriate shape. Typically, the upper table holds a male forming tool (a punch) having a bottom workpiece-deforming surface (such as a V-shaped surface), and the bottom table holds an appropriately-shaped female tool (a die) having an upper surface vertically aligned with the workpiece-deforming surface of the male tool.

As is known, the forming tools are commonly mounted to press brake tables via use of one or more tool holders provided on the tables. Particularly, tangs or shanks of the tools are inserted between opposing portions of the holder that define a channel. Quite often, the channel is defined via a stationary portion of a first wall and a movable portion of an opposing second wall of the tool holder. As forming tools are available in a variety of shapes and sizes, the tangs for the tools also vary, particularly with regard to their profiles. One tang type (generally known as American style) has smooth, straight vertical sides extending upward from the tool body, and upon which the opposing portions of a tool holder contact when the tang is loaded there between. Other tang types (generally known as European or precision styles) have one or more grooves defined in their vertical sides, which in some cases are used in self-seating the tools when they are loaded between and subsequently contacted by the opposing portions of the tool holder.

Each tang style offers its own specific advantages. For instance, in utilizing straight style tangs, tooling is often found to be relatively easy to load and remove from tool holders, and more easily accommodated by differing makes of tool holders. On the other hand, in utilizing grooved style tangs, tooling can be more precisely held by tool holders (via seating mechanisms) so as to machine workpieces with high degree of accuracy. Traditionally, tool holders were designed to accommodate only one style of tool tang. However, this correspondingly limited the various tooling that could be used with such holders. Thus, the press brake industry started seeing the introduction of tool holder designs capable of being used with tools having different tang styles. However, such designs have not been without drawbacks.

For example, many of these tool holders have been designed to function with adaptors in accommodating different tang styles. With some designs, the adaptors dictate being changed out (in the case of multiple adaptors) or reoriented (in the case of a single adaptor) to accommodate the different tang styles. Unfortunately, the need for orienting the adaptor not only leads to corresponding downtime for the machine, but also introduces risk of improper orientation and corresponding production errors. Conversely, in other perhaps more conventional tool holder designs, instead of varying orientation of adaptors to accommodate different tang styles, the adaptors are held in a set orientation, and moved inwardly toward the tool tangs at different distances corresponding to the tang styles. However, such differing movements, and corresponding variances in force applied to accommodate such movements, typically dictates precise regulation of the force, or else damage can result to the tangs and/or the tool holders from contact there between. Such regulation has conventionally been provided via hydraulic, pneumatic, electric, or other like means, whereby the applied forces can be precisely administered, although incorporation of these elements adds complexity and overall cost to the designs.

One variable not yet described but given consideration in the design of tool holders is built-in tolerance. For example, there is generally a slight degree of variance with each tool and tool holder design, such as relating to general dimensions of the tool (e.g., its tang) or to actions of the tool holder (e.g., closing action(s) of one or more movable portions of the holder). By themselves, these variances can be deemed fairly negligible; however, they can present issues when encountered collectively, such as in the circumstance of loading forming tools in tool holders. For example, such variances can result in a corresponding degree of play for the tooling once loaded into the tool holders. To account for such variances, areas of tolerance have been provided in the tool holder designs. For example, tool holders have often been equipped with shape memory materials or structures such as springs to provide such areas of tolerance within the designs. However, even with the addition of such elements, issues of looseness or play between tool and holder can still be found to exist.

Thus, there remains a need for a tool holder design that accounts for the above-described issues as well as others, and in so doing to provide both an effective and efficient tool holder usable with tools having different tang styles.

SUMMARY OF THE INVENTION

Embodiments of the invention involve tool holder designs. In some cases, the tool holder has a clamp assembly that can be used with tools having different tang styles. The tool holder in some cases has at least two differing tolerance areas provided therein, wherein the tolerance areas provide complementary tolerance to the design. In some cases, the tool holder can have a mechanically actuatable mechanism that functions with one or more internal components that limit adjustment of the mechanism to prevent damage to one or more of tool and the tool holder when securing the tool therein.

In one embodiment, a tool holder configured for use with tools having different tang styles is provided. The tool holder comprises housing, a mechanism that is mechanically actuatable, and a clamp assembly operably coupled to the mechanism. The mechanism is accessible through an opening defined in the housing. The clamp assembly comprises a clamp plate and one or more clamping fingers. The clamp plate is defined as a longitudinal body that has an extent spanning across the one or more clamping fingers. The longitudinal body of the clamp plate has an end contacting the one or more clamping fingers. The one or more clamping fingers are movable in order to secure tools having different tang styles between the fingers and a stationary wall of the housing. Movement of the one or more clamping fingers corresponds to movement of the clamp plate end which stems from adjustment of the mechanism. The clamp plate has at least two differing tolerance areas provided therein, a first tolerance area comprising a plurality of first slits defined across the extent of the clamp body end and thereby forming a plurality of clamp plate portions in contact with the one or more clamping fingers, a second tolerance area defined across a depth of each of the clamp plate portions.

In another embodiment, a tool holder configured for use with tools having different tang styles is provided. The tool holder comprises housing, a mechanism that is mechanically actuatable, and a clamp assembly operably coupled to the mechanism. The mechanism is accessible through an opening defined in the housing. The clamp assembly comprises a clamp plate and one or more clamping fingers. The clamp plate is defined as a longitudinal body that has an extent spanning across the one or more clamping fingers. The longitudinal body of the clamp plate has an end contacting the one or more clamping fingers which are moved for securing the tool between the fingers and a stationary wall of the housing. Movement of the one or more clamping fingers corresponds to movement of the clamp plate end which stems from adjustment of the mechanism. One or more components of the clamp assembly are contained within the housing and limit the adjustment of mechanism to prevent damage to one or more of tools having different tang styles and the tool holder when securing the tools between the one or more clamping fingers and a stationary wall of the housing. The clamp plate has at least two differing tolerance areas provided therein.

In a further embodiment, a tool holder is proved. The tool holder comprises housing, a mechanism that is mechanically actuatable, and a clamp assembly operably coupled to the mechanism. The mechanism is accessible through an opening defined in the housing. The clamp assembly comprises a clamp plate and one or more clamping fingers. The clamp plate is defined as a longitudinal body that has an extent spanning across the one or more clamping fingers. The longitudinal body of the clamp plate has an end contacting the one or more clamping fingers which are moved for securing the tool between the fingers and a stationary wall of the housing. Movement of the one or more clamping fingers corresponds to movement of the clamp plate end which stems from adjustment of the mechanism. The clamp plate has at least two differing tolerance areas provided therein, a first tolerance area comprising a plurality of first slits defined across the extent of the clamp body end and thereby forming a plurality of clamp plate portions in contact with the one or more clamping fingers and a second tolerance area defined across a depth of each of the clamp plate portions, the first and second tolerance areas collectively providing complementary tolerances to the one or more clamping fingers when securing the tool between the fingers and the stationary wall of the housing.

BRIEF DESCRIPTION OF THE DRAWINGS

The following drawings are illustrative of particular embodiments of the present invention and therefore do not limit the scope of the invention. The drawings are not necessarily to scale (unless so stated) and are intended for use in conjunction with the explanations in the following detailed description. Embodiments of the invention will hereinafter be described in conjunction with the appended drawings, wherein like numerals denote like elements.

DETAILED DESCRIPTION

The following detailed description is exemplary in nature and is not intended to limit the scope, applicability, or configuration of the invention in any way. Rather, the following description provides some practical illustrations for implementing exemplary embodiments of the present invention. Examples of constructions, materials, dimensions, and manufacturing processes are provided for selected elements, and other elements employ that which is known to those of ordinary skill in the field of the invention. Those skilled in the art will recognize that many of the noted examples have a variety of suitable alternatives.

Figure 1:
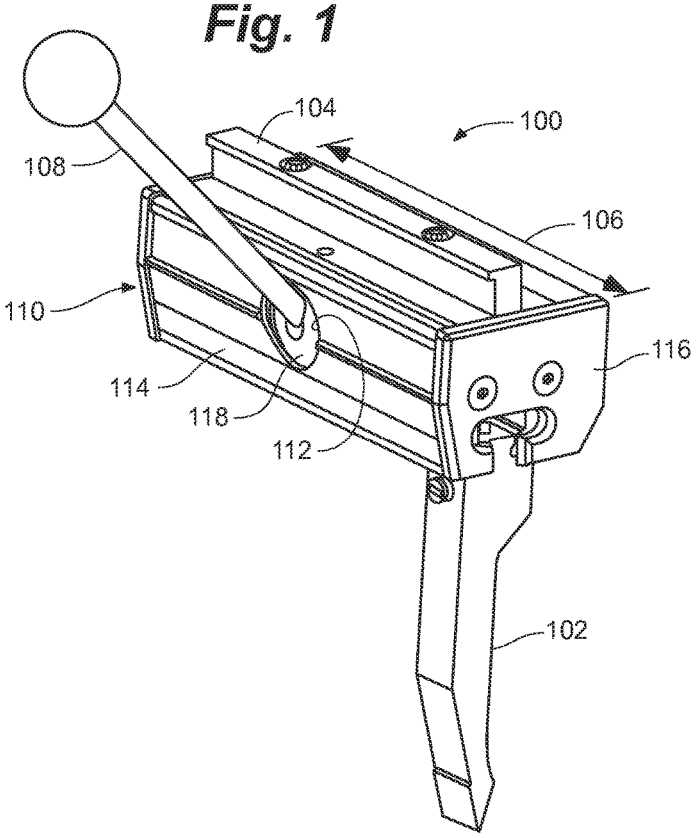
FIG. 1 is a perspective view of a tool holder in accordance with certain embodiments of the invention, wherein the tool holder is shown with exemplary forming tool loaded therein.

FIG. 1 shows a perspective view of a tool holder 100 in accordance with certain embodiments of the invention, wherein the holder 100 is depicted with exemplary forming tool 102 loaded therein. As shown (and similar to tool holders 200 of FIG. 10, 300 of FIG. 14, and 400 of FIG. 19), the tool holder 100 is modular in design. Thus, while in certain embodiments, the holder 100 can be operatively coupled to a table (e.g., upper table) of a press brake machine (e.g., via elongated bar 104) or alternatively formed with such table, the holder 100 could just as well be used with other industrial machines. For example, the tool holders 100, 200, 300, and 400 can be used with industrial machines configured to provide any of a variety of forming processes, such as bending, folding, and/or forming holes in sheet metal and other workpieces. Also, while the tool holders 100, 200, 300, and 400 are exemplarily shown as being generally compact in size, their lengths in particular (e.g., length 106 of the holder 100) can be varied as desired (e.g., based on length of intended table and tooling application for a press brake).

Figure 2A:
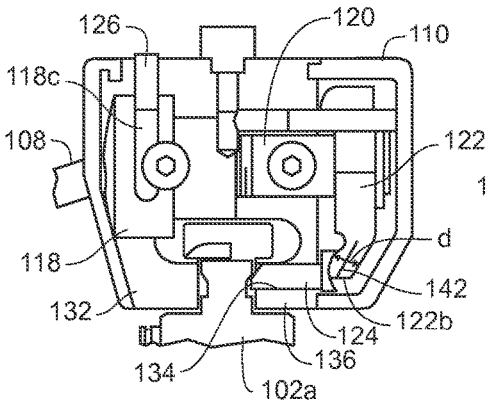
FIGS. 2A and 2B are internal side views of the tool holder of FIG. 1 showing different tang styles loaded in the holder in accordance with certain embodiments of the invention.
Figure 2B:
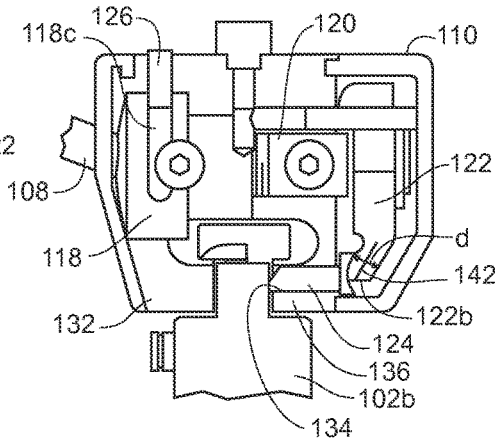

Continuing with FIG. 1 (and with reference to FIGS. 2A and 2B, showing alternate internal views), a majority of the components of the tool holder 100 are internally situated within a housing 110 of the holder 100. This is similarly depicted for the tool holder 200 of FIG. 10 (with reference to cross-sectional view of FIG. 11), the tool holder 300 of FIG. 14 (with reference to cross-sectional view of FIG. 15), and the tool holder 400 of FIG. 19 (with reference to internal view of FIG. 20). As such, these internalized components of the holders are not only generally protected from general contaminants from the work surroundings, but also configured for standard use without requiring alteration by operator.

Figure 14:
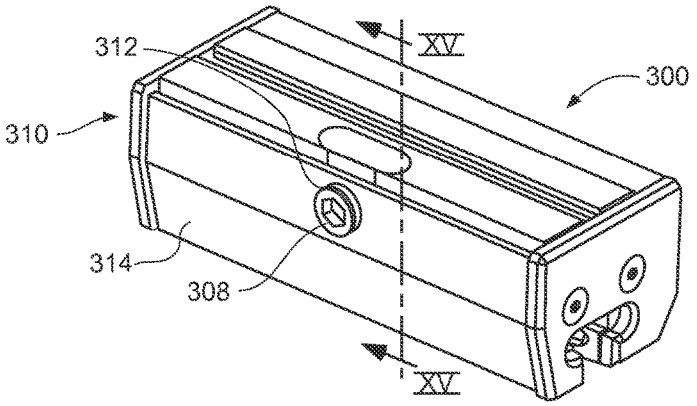
FIG. 14 is a perspective view of another tool holder in accordance with certain embodiments of the invention.
Figure 19:
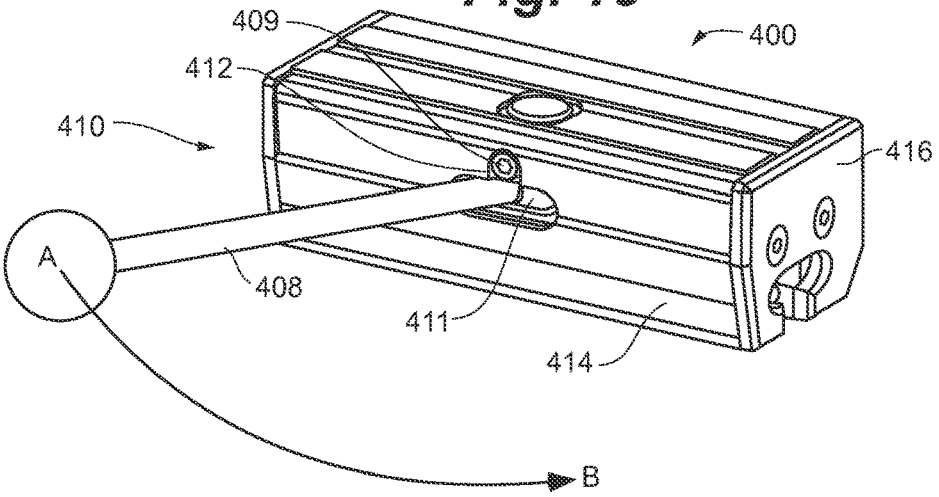
FIG. 19 is a perspective view of a further tool holder in accordance with certain embodiments of the invention.

As described above, non-mechanical sources (e.g., hydraulic, pneumatic, electrical, or other like means) have often been implemented with tool holder designs to precisely regulate their actuation. However, use of such sources has also typically resulted in enhanced complexity and/or cost for the system. In contrast to such systems, the tool holders 100, 200, 300, 400 embodied herein can be configured to be mechanically actuated. Particularly, for each of the tool holders 100, 200, 300, and 400, an actuator mechanism is provided and exposed through the tool holder housing, thereby being accessible to an operator. For instance, with reference back to the tool holder 100 of FIG. 1, a handle or arm 108 extends from the housing 110. Similarly, the tool holder 300 of FIG. 14 shows clutch mechanism 308 being exposed, while the tool holder 400 of FIG. 19 shows handle or arm 408 used in conjunction with transfer screw 409, with each being exposed.

Figure 10:
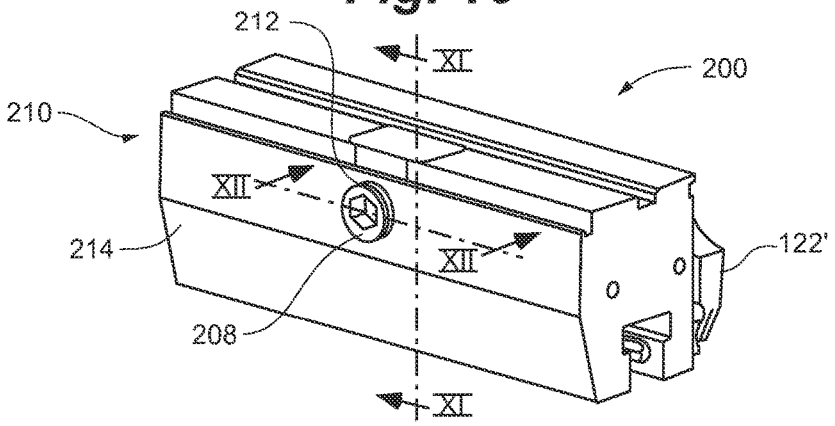
FIG. 10 is a perspective view of an additional tool holder in accordance with certain embodiments of the invention.

In contrast to the above-described configurations, while the tool assembly 200 of FIG. 10 shows a torque screw mechanism 208 being exposed through the tool holder housing 210, there is the possibility for additional components (e.g., clamp plate 122') to also be exposed and thus accessible to the operator. To that end, if certain components of the tool holders dictate periodic visual inspection or maintenance thereto, the housing design can be correspondingly altered. Nevertheless, while the tool holder 200 exemplarily depicts such an alternate design, its housing 210 could just as well be provided similar to the housing 310 of tool holder 300, whereby the clamp plate 122" is provided within the housing (as should be ascertained when comparing FIGS. 11 and 15). Thus, while not shown, it should also be appreciated that the housing design of the tool holders 100, 300, and 400 could be alternatively configured, e.g., similar to housing design of tool holder 200.

As described above, the tool holders 100, 200, 300, 400 can each be configured to be mechanically actuated. Such mechanical actuation, in certain embodiments, stems from an actuator mechanism being provided with the tool holders and made accessible so as to be manually adjusted. To that end, in certain embodiments, the actuator mechanisms are configured to be adjusted via operator action. In cases of securing a tool within the tool holders, in certain embodiments, the manual adjustment made to the actuator mechanism is performable in a singular step or action. As will be further described herein, use of the actuator mechanism enables tools to be secured within the holders, while also providing the clamping pressure warranted for the tool tang style being used. In certain embodiments, the magnitude of such pressure resulting from use of the actuating mechanism is not only provided to secure tools within the holders, but also correspondingly regulated at the point of the actuator mechanism so as to minimize risk of damage to the tool and/or the tool holder.

With the above description serving as a backdrop, focus is turned back to the tool holder 100 of FIG. 1. As already noted above, the tool holder 100 involves a housing 110 with a majority of the components of the holder 100 being held therein. For actuation of the tool holder 100, the arm 108 is used, and is shown extending from a bore 112 defined in the housing 110 (e.g., in front housing wall 114). As already described, FIGS. 2A and 2B show internal side views of the tool holder 100, specifically showing tools with different tang styles secured thereto (with grooved style 102*a* being illustrated in FIG. 2A, and straight style 102*b* being illustrated in FIG. 2B). The views show the holder 100 with side face plate 116 of the housing 110 removed, and, as further detailed below, depict positions of the components contained within the housing 110 based on different positions of the arm 108 (partially shown in each of FIGS. 2A and 2B). In certain embodiments, the internal components include a clamping nut 118, a clamping bolt 120, a clamp plate 122, and one or more clamping fingers 124. Such internal components, when collectively referenced herein moving forward, are denoted as the clamping assembly 130 (see FIG. 4, separately showing the assembly 130), and can further include the actuator mechanism, e.g., the arm 108 of holder 100.

Figure 13:
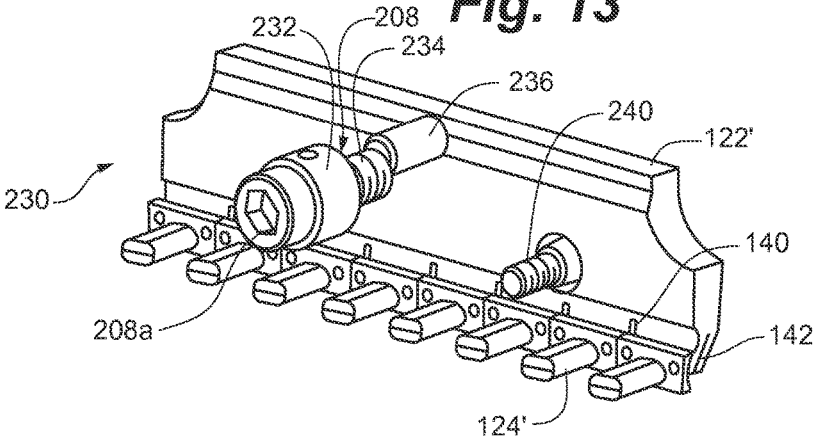
FIG. 13 is a perspective view of clamp assembly of the tool holder of FIG. 10 in accordance with certain embodiments of the invention.
Figure 18:
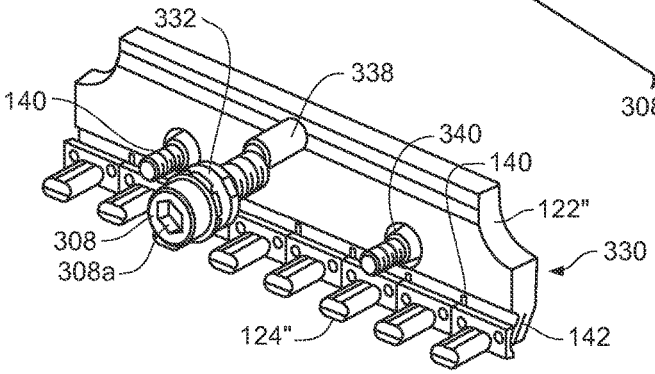
FIG. 18 is a perspective view of clamp assembly of FIG. 14 in accordance with certain embodiments of the invention.
Figure 21:
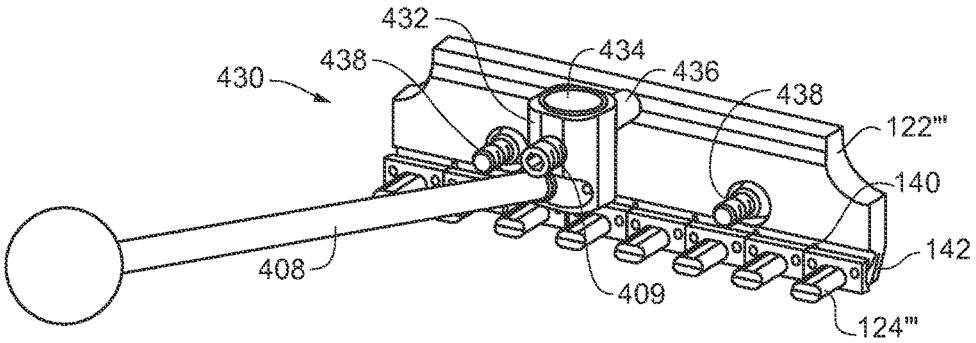
FIG. 21 is a perspective view of clamp assembly of the tool holder of FIG. 19 in accordance with certain embodiments of the invention.

Similar to the tool holder 100 of FIG. 1, each of the tool holders 200 of FIG. 10, 300 of FIG. 14, and 400 of FIG. 19 are configured with a mechanically-based clamping assembly: assembly 230 as shown in FIG. 13, assembly 330 as shown in FIG. 18, and assembly 430 as shown in FIG. 21, respectively. As will be further described herein, the clamp assemblies 130, 230, 330, and 430 have their own structural distinctions; however, each includes a clamp plate and one or more clamping fingers. To that end, given manual adjustment of the actuator mechanisms of these tool holders, the positioning of the clamp plates is correspondingly varied in concert with the one or more clamping fingers to secure/release tools having different tang styles from the holders. In certain embodiments, different adjustments of the actuator mechanisms are respectively needed for each tool having a different tang style. However, in other embodiments, the same adjustment can be dictated for the actuator mechanisms regardless of tool tang style.

Figure 3:
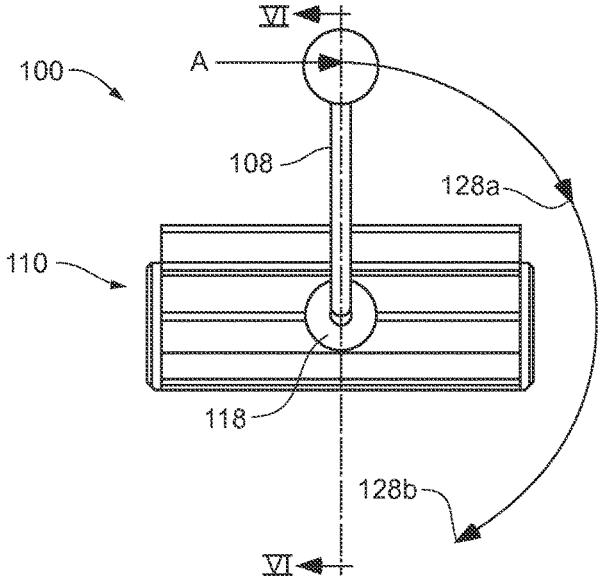
FIG. 3 is a front view of the tool holder of FIG. 1.
Figure 5A:
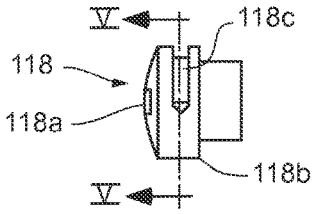
FIGS. 5A, 5B, and 5C are side, cross-sectional, and perspective views of a clamping nut of the clamp assembly of FIG. 4 in accordance with certain embodiments of the invention, with FIG. 5B taken along the lines V-V in FIG. 5A.
Figure 4:
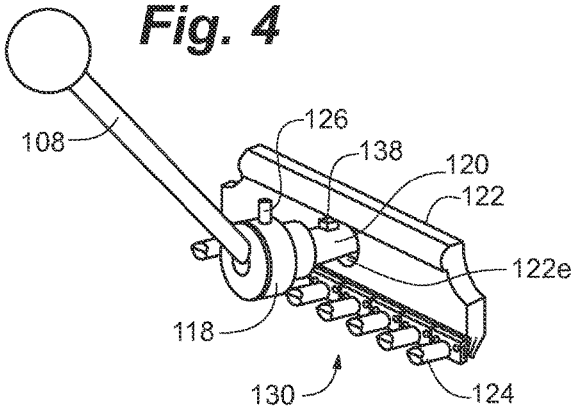
FIG. 4 is a perspective view of clamp assembly of the tool holder of FIG. 1 in accordance with certain embodiments of the invention.
Figure 5B:
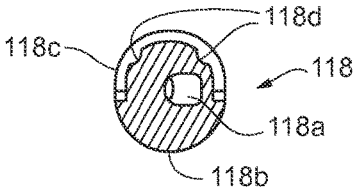
Figure 5C:
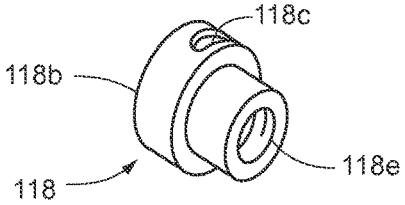
Figure 6:
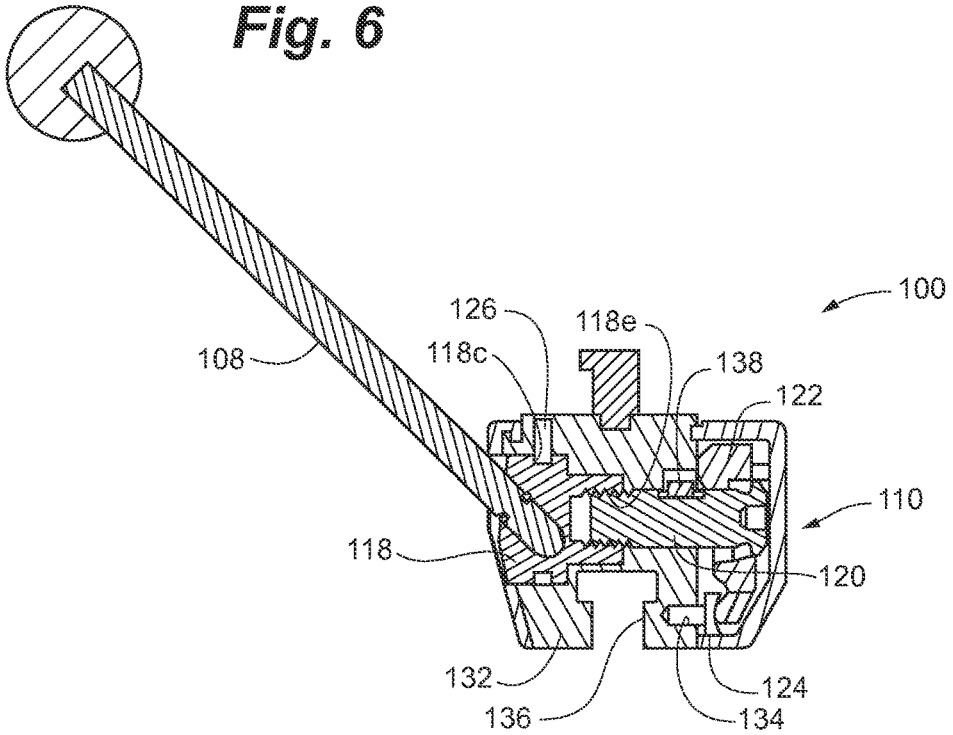
FIG. 6 is a cross-sectional view of the tool holder of FIG. 3 taken along the lines VI-VI.

With reference back to tool holder 100, FIG. 3 shows a front view of the tool holder 100, which depicts range of motion (or adjustment) for the arm 108 in accordance with certain embodiments of the invention. To that end, the arm 108 is configured for rotation relative to the housing 110 of the holder 100. With reference to FIG. 4, the arm 108 is operably coupled to the clamping nut 118 so that the arm 108 and nut 118 correspondingly rotate together. FIGS. 5A, 5B, and 5C illustrate side, cross-sectional, and perspective views of the clamping nut 118. With reference to FIG. 5A (and FIG. 6, showing cross-sectional view of tool holder 100), in certain embodiments, the coupled end of the actuator arm 108 is received within corresponding bore 118*a* defined in head 118*b* of the clamping nut 118. Further (and with reference to FIG. 4), the bore 118*a*, in certain embodiments, has elongated shape such that the actuator arm 108 can be further angled (toward the housing 110) in order to create a levered structure in rotating the arm 108 about the housing 110.

With reference back to FIG. 3, in certain embodiments, the rotation of the actuator arm 108 and the clamping nut 118, collectively, is limited to a range of not more than 180°. Turning back to FIGS. 2A/2B, the limited range of rotation for the arm 108, in certain embodiments, is based on cooperation of stop pin 126 rigidly held within housing 110 and channel 118*c* defined in outer circumference of the clamping nut head 118*b*. Particularly, the pin 126 is aligned to extend into channel 118*c*, whereby the rotation of the nut 118 is limited to the channel's extent. With reference to FIGS. 5A-5C, the channel 118*c* of the clamping pin 118 is perhaps most clearly depicted. Particularly, FIG. 5C shows initial orientation of clumping nut 118 as provided in the housing 110 when arm 108 is in starting position A (see FIG. 3). As further shown in FIGS. 5A and 5B, the channel 118*c*, in certain embodiments, extends no more than 180° about the outer circumference of the clamping nut head 118*b*, thus correspondingly limiting rotation of both the clamping nut 118 and the arm 108 to such range.

Along the range of rotation of the arm 108, in certain embodiments, there are multiple stop points for the arm 108 (e.g., defined in channel 118*c* via corresponding detents 118*d*; although, corresponding binding force between fingers 124 and tang styles, along with gravitational force on arm 108, at such points can be sufficient without use of detents). In certain embodiments, these stop points correspond to the quantity of differing tang styles the holder 100 is configured to accommodate. Looking back to FIG. 3, the arm 108 and nut 118 are shown to have at least two set stopping points, one point 128*a* with regard to straight style tangs 102*b* (as depicted in FIG. 2*b*) and another point 128*b* with regard to grooved style tangs 102*a* (as depicted in FIG. 2*a*). With reference to FIGS. 2A, 2B, and 3, when the arm 108 is moved in clockwise manner (starting from point A), the clamp plate 122, and correspondingly, the one or more clamping fingers 124, of the clamping assembly 130 are traversed inward of the holder 100 to requisite extent with respect to far wall 132 of the housing 110. Particularly, the stopping points 128*a* and 128*b* along the range of rotation correspond with the extents by which the one or more clamping fingers 124 are made to project from corresponding bores 134 defined in near wall 136 for securing the differing tang styles 102*b* and 102*a*, respectively, when loaded between walls 132, 136.

Turning back to clamping assembly 130 of FIG. 4, the clamping nut 118 is adjustably coupled to the clamping bolt 120, and the clamping bolt 120 is in turn operably coupled to the clamp plate 122. In certain embodiments (and with further reference to perspective view of clamping nut 118 shown in FIG. 5C), the clamping nut 118 is defined with threaded bore 118*e* opposite its head 118*b*, configured to threadedly receive an end of clamping bolt 120, as shown in cross-sectional view of tool holder 100 of FIG. 6. Continuing with reference to FIGS. 4 and 6, the bolt 120 is held rotationally stationary via contact with an orientation pin 138 rigidly held within the housing 110. Thus, when the arm 108 is rotated from initial point A to one of the stopping points 128*a* or 128*b*, the clamping nut 118 correspondingly rotates about the bolt 120. However, because the bolt 120 is rotationally held, the bolt 120 correspondingly moves inward of the nut 118.

Figure 7:
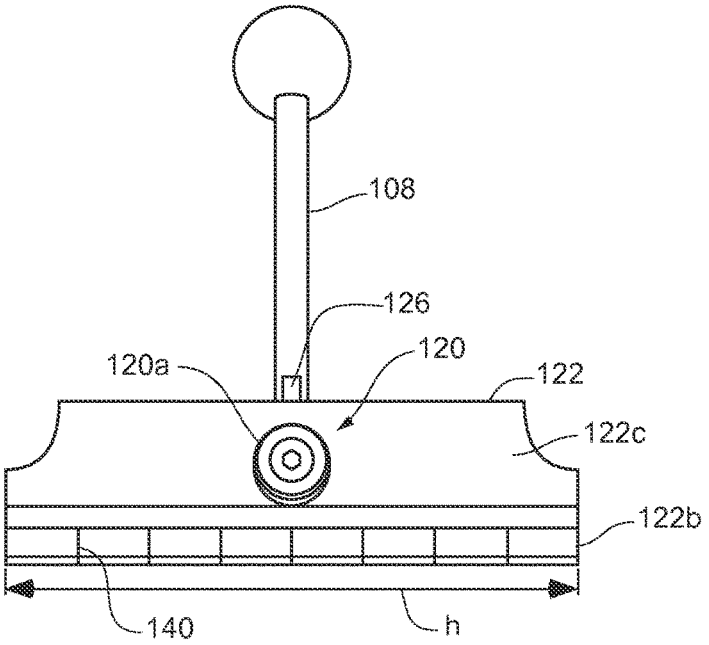
FIG. 7 is a rearward view of the clamp assembly of FIG. 4.
Figure 8:
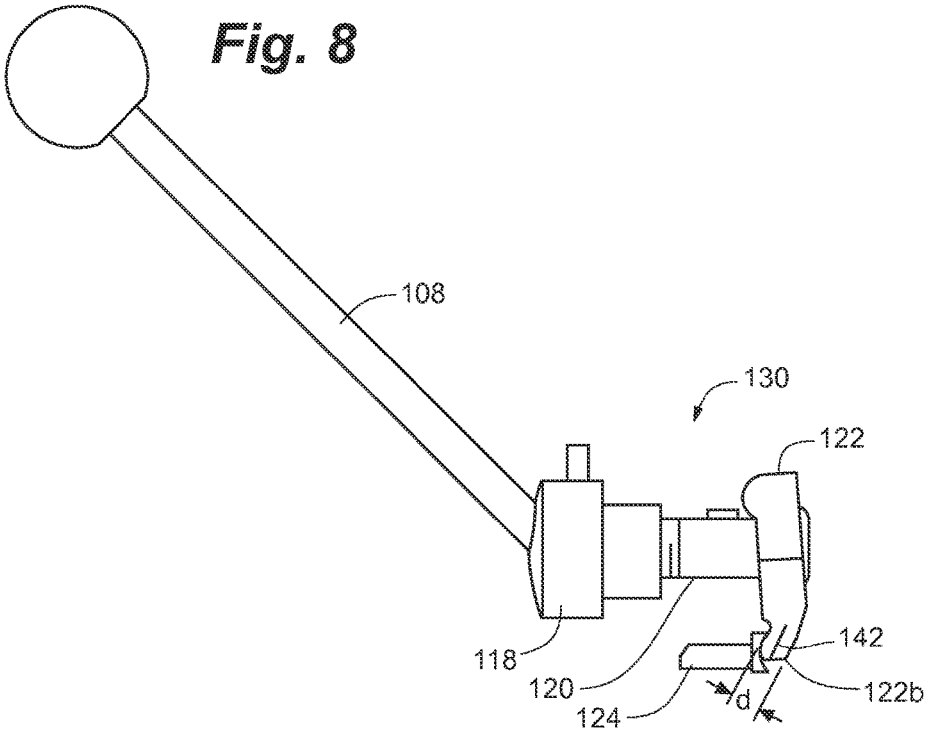
FIG. 8 is a side view of the clamp assembly of FIG. 4.

Continuing with reference to FIGS. 4 and 6, in certain embodiments as shown, the clamping bolt 120 extends through a bore 122*e* defined in the clamp plate 122, with head 120*a* of the bolt 120 positioned at rear side 122*c* of the plate 122 (shown in FIG. 7). Thus, rotation of the arm 108 toward stopping points 128*a* or 128*b* results in corresponding rotation of the clamping nut 118, which results in corresponding receipt of clamping bolt 120 within the nut 118 and inward pull of the clamp plate 122. Such inward pull of the clamp plate 122 triggers corresponding protrusion of the one or more clamping fingers 124 toward tool tang loaded between tool holder walls 132, 136. With reference back to FIG. 3, greater rotation of the arm 108 corresponds to greater projection of the fingers 124. Thus, with the fingers 124 needing to protrude further to contact grooved style tangs, greater rotation of the arm 108 (to stopping point 128*b*) is warranted, while a lesser rotation of the arm 108 (to stopping point 128*a*) is comparatively needed for fingers 124 to contact straight style tangs.

Of course, for releasing the differing tang styles of loaded tools from the tool holder 100, the arm 108 is correspondingly rotated counterclockwise back to starting point A from either of stopping points 128*a* or 128*b*. To that end, such rotation of the arm 108 results in corresponding rotation of the clamping nut 118, which results in corresponding withdrawal of portion of clamping bolt 120 from the nut 118 and outward extension of its head 120*a*, which results in corresponding outward movement of the clamp plate 122 and in turn corresponding retraction of the fingers 124 from channel of the tool holder 100 back into corresponding bores 134 of near wall 136.

As described above, built-in tolerance is considered in the design of tool holders, and such consideration is not lost in the embodied tool holder designs. The tolerance areas of the tool holders 100 of FIG. 1, 200 of FIG. 10, 300 of FIG. 14, and 400 of FIG. 19 are configured with same tolerance areas due to common use of clamp plate and one or more clamping fingers in their clamp assemblies. To that end, it has been determined in the tool holder designs embodied herein that by introducing areas of tolerance both in line with force being applied to the clamping fingers 124 (along horizontal extent of the contacting end 122*b* of the clamp plate 122) and transverse (or crosswise) to such force (within depth of contacting end 122*b* of the clamp plate 122), there is enhanced tolerance gleaned from the designs. For example, there is virtually no degree of freedom or play between clamping portion(s) of tool holder 100 and tools secured therein. To that end, this complementing of tolerances functions particularly well with use of differing tang styles. One rationale for this is because such tolerances areas, via their close proximities to each other and their focus on differing (e.g., transverse) planes relative to the applied forces, are better matched for collective function.

Figure 9A:
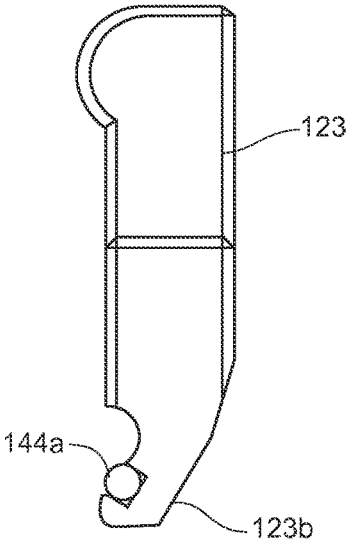
FIGS. 9A and 9B are side views of alternate clamp plates usable with the clamp assembly of FIG. 4 in accordance with certain embodiments of the invention.
Figure 9B:
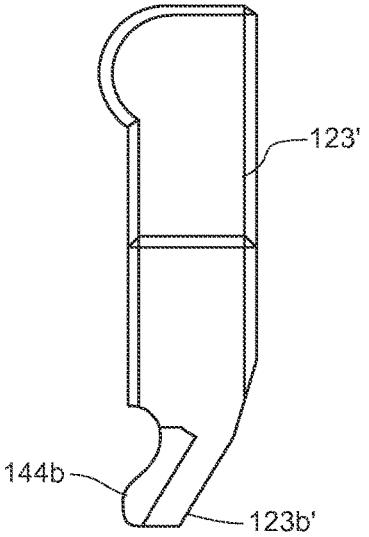

In certain embodiments, as shown in FIGS. 2A/B, 7, and 8, the areas of tolerance for the tool holder 100, and particularly, the clamp assembly 130, are provided as a plurality of slits 140 defined along horizontal extent h of the contacting end 122*b* of the clamp plate 122 (as perhaps best shown with reference to FIG. 7) and a plurality of slits 142 defined within depth d of contacting end 122*b* of the clamp plate 122 (perhaps best shown with reference to FIGS. 2A/B and 8). To that end, given their distribution on the plate 122, the slits 140, 142 are collectively actuated when subjected to forces of 400 pounds, which are common for tool—tool holder clamping forces, but not to the extent that the tolerance provided would be negligent. With reference to FIGS. 9A and 9B, further analysis has shown that the slits 142 defined within the depth d of the clamp plate 122 can be altered while still creating tolerance areas that are a sufficient match for the expected forces. To that end, in certain embodiments, alternate clamp plate configurations 123, 123' could be used, with cut portions at the clamp ends 123*b*, 123*b*' being filled with shape memory material 144*a*, 144*b*, such as urethane.

Moving on to the other tool holders 200 of FIG. 10, 300 of FIG. 14, and 400 of FIG. 19, as described above, they have similar designs as compared to the tool holder 100. Particularly, they can have mechanically actuator mechanisms and similarly include and use like-designs of clamp plates and clamping fingers. To that end, the tolerance areas of the holders 200, 300, and 400 can be advantageously impacted similarly using same configuration of slits (or combination of slits and shape memory material) for the clamp plates, as has been described. As further described above, while they share similar overall function with the tool assembly 100 (i.e., to secure tools with differing tang styles, while providing warranted pressure on such tang styles), the tool holders 200, 300, and 400 vary in their structure and as such have correspondingly varied manner of accomplishing such function via their clamp assemblies 230, 330, and 430, respectively.

Starting with the tool holder 200 of FIG. 10, as described above, it includes a housing 210 containing a majority of the components of the holder 200. As further described, the actuation mechanism of the tool holder 200 takes the form of a torque screw mechanism 208. In certain embodiments as shown, the mechanism 208 protrudes from a bore 212 defined in the housing 210 (e.g., via a front wall 214 thereof). To that end, the mechanism 208 is configured for rotation (e.g., via Allen head as shown) relative to the housing 210 in order to mechanically actuate the holder 200. With reference to FIG. 13, the clamp assembly 230 of the tool holder 200 is formed of the mechanism 208, an internal clutch 232, a threaded insert 234, a transfer pin 236, a clamp plate 122', and one or more clamping fingers 124'. As will be understood when comparing with the tool holder 100 of FIG. 1, the clamp assembly 230 of the tool holder 200 is reliant on the magnitude of actuating force applied to the actuator mechanism rather than the styles of tangs used therewith.

Figure 11:
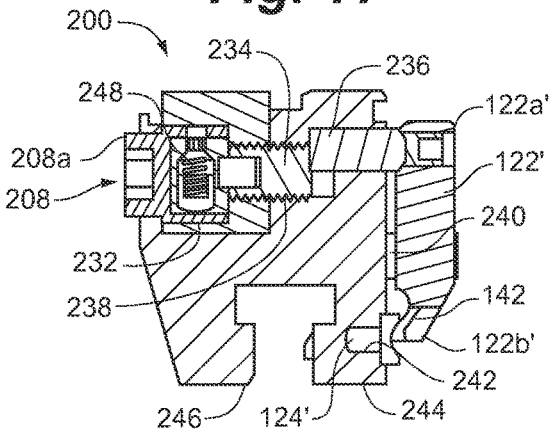
FIG. 11 is a cross-sectional view of the tool holder of FIG. 10 taken along the lines XI-XI in accordance with certain embodiments of the invention.

With reference to FIG. 11, the internal clutch 232 is operably joined to the torque screw mechanism 208 under normal loading. As such, the mechanism 208 and clutch 232 are configured to turn together. As shown, the clutch 232 is further linked to threaded insert 234, such that when the clutch 232 rotates, the threaded insert 234 is moved outward along internal threading 238. Given this outward movement of the insert 234, the transfer pin 236 is correspondingly moved outward (via end-to-end contact with the insert 234). As shown, outward movement of the transfer pin 236 results in corresponding outward movement with an end 122*a*' of the clamp plate 122' opposite the plate end 122*b*' contacting the clamping fingers 124'. Such outward deflection of the plate end 122*a*' results in the plate 122' pivoting about one or more bolts 240, such that opposing clutch plate end 122*b*' engages the clamping fingers 124', causing them to project out from corresponding bores 242 defined in near wall 244 of holder 200 for securing loaded tool tang against opposite wall 246 of holder 200.

Figure 12:
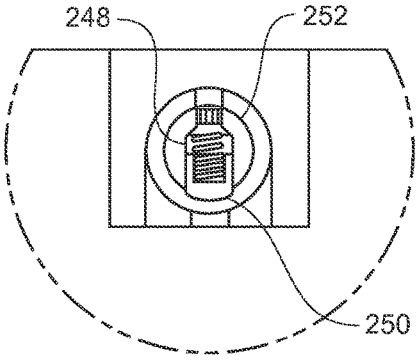
FIG. 12 is a cross-sectional view of partial portion of the tool holder of FIG. 10 taken along the lines XII-XII in accordance with certain embodiments of the invention.

Turning to FIG. 12 (and with reference to FIG. 11), under intended loading of head 208*a* of the torque screw mechanism 208, the internal clutch 232 is held thereto via clutch pin 248 extending into pocket 250 of clutch track 252. However, in the event of higher than intended loading being applied to the head 208*a* (and thereby the mechanism 208), such as in the event of the clamping fingers 124' being brought against tool tang, the clutch pin 248 is forced out of the track pocket 248, thereby actuating the clutch 232 to disengage from the mechanism 208. Thus, the mechanism 208 is left to spin freely and unengaged. To that end, mechanism 208 is only left to be rotated in opposite fashion so as to be correspondingly reengaged by clutch 232 (via clutch pin 248), wherein reverse rotation of the clutch 232 would correspond to pulling back of the threaded insert 234, the transfer pin 236, and the clamp plate 122', with clamping fingers 124' corresponding retracting from tool for its release. Otherwise, the fingers 124' would continue to be in their protruding state, securing tool.

Moving on to the tool holder 300 of FIG. 14, as described above, it includes a housing 310 containing a majority of the components of the holder 300. As further described, the actuation mechanism of the tool holder 300 takes the form of a clutch screw 308. In certain embodiments as shown, the screw 308 protrudes from a bore 312 defined in the housing 310 (e.g., in front wall 314 thereof). To that end, the screw 308 is configured for rotation (e.g., via Allen head as shown) relative to the housing 310 in order to mechanically actuate the holder 300. With reference to FIG. 18, the clamp assembly 330 of the tool holder 300 is formed of the clutch screw 308 (more particularly, a clutch screw head 308*a*), a clutch plate 332, a clutch spring 334, a transfer screw 336, a transfer pin 338, a clamp plate 122", and one or more clamping fingers 124". As will be understood and similar to the tool holder 200 of FIG. 10, the clamp assembly 330 of the tool holder 300 functions with a torque threshold, which if exceeded, automatically disengages the head 308*a* of the clutch screw 308. Thus, the clamp assembly 330 of the tool holder 300 is reliant on the magnitude of actuating force applied to the actuator mechanism rather than styles of tangs used therewith.

Figure 15:
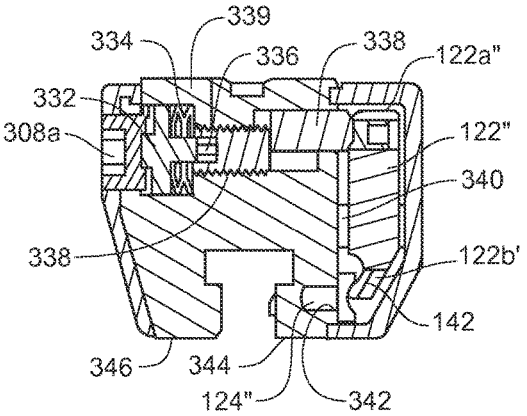
FIG. 15 is a cross-sectional view of the tool holder of FIG. 14 taken along the lines XV-XV.
Figure 17:
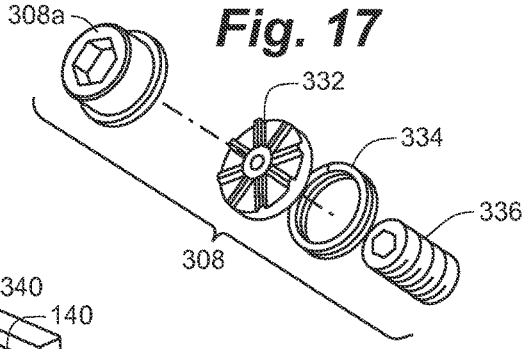
FIG. 17 is an exploded perspective view of the clutch mechanism of FIG. 16.

Much like the clamp assembly 230 of tool holder 200, the head 308*a* of the clutch screw 308 is operably configured with an assembly that comes apart upon higher than intended loading being exerted thereto (via the clutch screw's 308 actuation). Particularly, with reference to FIG. 17, under conditions of intended loading for rotation of the clutch screw 308, the screw head 308*a* is configured to act in unison with the clutch plate 332, the clutch spring 334, and the transfer screw 336. To that end, the screw head 308*a* and the clutch plate 332, under normal loading of the head 308*a*, are configured to turn together based on clutch spring 334 acting thereon in pocket 339 defined in housing 310. Turning to FIG. 15, the clutch plate 332 is linked to transfer screw 336, such that when the clutch plate 332 rotates, the transfer screw 336 is moved outward along internal threading 338. Given this outward movement of the transfer screw 336, the transfer pin 338 is correspondingly moved outward (via end-to-end contact with the screw 336). As shown, outward movement of the transfer pin 338 results in corresponding outward movement with an end 122*a*" of the clamp plate 122" opposite the plate end 122*b*" contacting the clamping fingers 124". Such outward deflection of the plate end 122*a*" results in the plate 122" pivoting about one or more bolts 340, such that opposing clutch plate end 122*b*" engages the clamping fingers 124", causing them to project out from corresponding bores 342 defined in near wall 344 of holder 300 for securing loaded tool tang against opposite wall 346 of holder 300.

Figure 16:
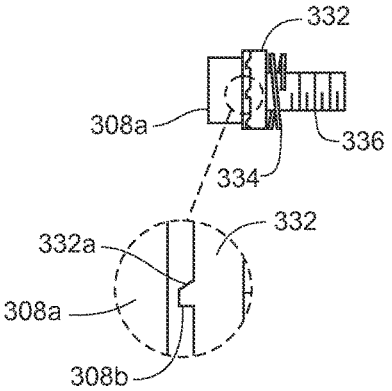
FIG. 16 is a side view of clutch mechanism (shown in FIG. 15) of the tool holder of FIG. 14, with enlarged partial view of clutch head and clutch plate being further shown.

Turning to FIGS. 15 and 16, under intended loading of the head 308*a* of the torque screw mechanism 308, the clutch plate 332 is operably joined to the head 308*a* via pressure by clutch spring 334 from confinement within housing pocket 339. However, in the event of higher than intended loading being applied to the head 308*a* (and thereby the clutch screw 308), such as in the event of the clamping fingers 124" being brought against tool tang, the clutch spring 334 will collapse, thereby allowing clutch plate teeth 332*a* to disengage with the mating recesses 308*b* defined about an underside of the head 308*a*. Once such disengagement occurs, the head 308*a* is left to spin freely and unengaged. To that end, head 308*a* is only left to be rotated in opposite fashion so as to be correspondingly reengaged with clutch plate 332 (via return to recoiled state for the clutch spring 334), wherein reverse rotation of the clutch plate 232 would correspond to pulling back of the transfer screw 336, the transfer pin 338, and the clamp plate 122", with clamping fingers 124" correspondingly retracting from tool for its release. Otherwise, the fingers 124" would continue to be in their protruding state, securing tool.

Further looking to the tool holder 400 of FIG. 19, as described above, it includes a housing 410 containing a majority of the components of the holder 400. As further described, the actuation mechanism of the tool holder 400 takes the form of a handle or arm 408 used in conjunction with transfer screw 409. In certain embodiments as shown, the arm 408 and screw 409 both protrude from corresponding slot 411 and bore 412, respectively, defined in the housing 410 (e.g., in front wall 414 thereof). To that end, the screw 409 is configured for rotation (e.g., via Allen head as shown) relative to the housing 410 in order to set the clamping system 430 for either a straight style tang (for which the screw 409 is backed from the housing 410) or a grooved style tang (for which the screw 409 is advanced into the housing 410).

Upon the transfer screw 409 being provided in the setting corresponding to the intended tang style, the arm 408 is used to mechanically actuate the holder 400. With reference to FIG. 21, the clamp assembly 430 of the tool holder 400 is formed of the arm 408, a cam cartridge 432, a cam 434, a transfer pin 436, a clamp plate 122'", and one or more clamping fingers 124'". As should be appreciated, actuation for the holder 400 via arm 408 is somewhat similar to the holder 100 of FIG. 1 as advancement of the arm 408 along range of rotation (from A to B as shown) results in the clamp plate 122'" being pushed on one end 122*a*'" so as to inwardly pivot its opposing end 122*b*'" in contact with the clamping fingers 124'", thereby moving the fingers 124'" into contact with the intended style of tang, as further detailed below.

Figure 20:
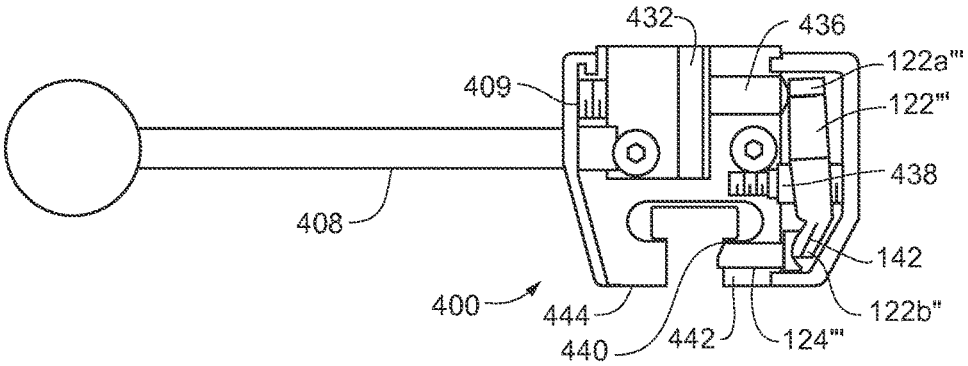
FIG. 20 is an internal side view of the tool holder of FIG. 19.

Reference is made to FIG. 20, showing internal side view of housing 410 with its side wall 416 removed in accordance with certain embodiments of the invention. As illustrated, upon actuation (or rotation) of the arm 408, the cam 434 within the cam cartridge 432 is shifted in orientation (rotated), whereby a corresponding outer side surface of the cam 434 is brought in contact with corresponding inner wall of cam cartridge 432, thereby outwardly deflecting opposing outer wall of the cartridge 432 against the transfer pin 436. Via such contact with outer wall of cam cartridge 432, the pin 436 is correspondingly directed against clamp plate end 122*a*'" such that plate 122'" pivots about one or more bolts 438, whereby opposing clutch plate end 122*b*'" deflects the clamping fingers 124'", causing them to project out from corresponding bores 440 defined in near wall 442 of holder 400 for securing loaded tool tang against opposite wall 444 of holder 400.

For releasing the differing tang styles of loaded tools from the tool holder 400, the arm 408 is correspondingly rotated back (from point B to point A). To that end, such rotation of the arm 108 results in corresponding rotation of the cam 434 to its original orientation, which results in clamp plate 122'" pivoting back to its prior position, and in turn corresponding retraction of the fingers 124'" from channel of the tool holder 400 back into corresponding bores 440 of near wall 442.

Thus, embodiments of a TOOL HOLDER WITH MECHANICALLY-ACTUATED CLAMP ASSEMBLY AND USABLE FOR TOOLING HAVING DIFFERENT TANG STYLES are disclosed. One skilled in the art will appreciate that the invention can be practiced with embodiments other than those disclosed. The disclosed embodiments are presented for purposes of illustration and not limitation, and the invention is limited only by the claims that follow.

What is claimed is:

1. A tool holder configured for use with tools having different tang styles, the tool holder comprising:

a housing;

a mechanism that is mechanically actuatable, the mechanism accessible through an opening defined in the housing; and a clamp assembly operably coupled to the mechanism and comprising:

a clamp plate; and one or more clamping fingers;

wherein the clamp plate is defined as a longitudinal body that has an extent spanning across the one or more clamping fingers, the longitudinal body of the clamp plate having an end contacting the one or more clamping fingers, the one or more clamping fingers movable in order to secure tools having different tang styles between the fingers and a stationary wall of the housing, movement of the one or more clamping fingers corresponding to movement of the clamp plate body end which stems from adjustment of the mechanism; and wherein the clamp plate has at least two differing tolerance areas provided therein to enable different degrees of freedom or play for the clamp plate body end both in direction of corresponding movement of the end and in crosswise direction when securing a tool via the clamp assembly, a first tolerance area comprising a plurality of first slits each defined across the extent of the clamp plate body end and thereby forming a plurality of clamp plate portions in contact with the one or more clamping fingers, a second tolerance area defined across a depth of each of the clamp plate portions.

2. The tool holder of claim 1 wherein the first and second tolerance areas collectively provide complementary tolerances to the one or more clamping fingers when securing a tool between the fingers and the stationary wall of the housing.

3. The tool holder of claim 1 wherein the extent of the clamp body is crosswise to the corresponding movements of the clamp plate end and the one or more clamping fingers such that the slits of the first plurality provide tolerance crosswise to such corresponding movements, and whereas the second tolerance area provides tolerance in direction of such corresponding movements.

4. The tool holder of claim 3 wherein the second tolerance area comprises a plurality of second slits each defined at a depth within corresponding of the clamp plate portions.

5. The tool holder of claim 4 wherein the slits of the first plurality are defined to extend in crosswise orientation to the slits of the second plurality.

6. The tool holder of claim 3 wherein the second tolerance area comprises shape memory material provided on each of the clamp plate portions at points of contact with the one or more clamping portions.

7. The tool holder of claim 6 wherein the clamp plate portions are defined with cutaway portions for positioning of said shape memory material.

8. The tool holder of claim 1 wherein one or more components of the clamp assembly are contained within the housing and operably coupled between the mechanism and the clamp plate to limit the adjustment of the mechanism and prevent damage to one or more of tools having different tang styles and the tool holder when securing the tools between the fingers and the housing stationary wall.

9. The tool holder of claim 8 wherein the mechanism is an arm having an end operably coupled to the components, wherein the predetermined range of adjustment is a range of rotation of the arm relative to the housing, wherein the range of rotation of the arm is limited to no more than 180°.

10. The tool holder of claim 8 wherein the mechanism comprises a screw head, wherein the predetermined range of adjustment is a range of rotation of the screw head up to a maximum torque being applied to the head.

11. A tool holder configured for use with tools having different tang styles, the tool holder comprising:

a housing;

a mechanism that is mechanically actuatable, the mechanism accessible through an opening defined in the housing; and a clamp assembly operably coupled to the mechanism and comprising:

a clamp plate; and one or more clamping fingers;

wherein the clamp plate is defined as a longitudinal body that has an extent spanning across the one or more clamping fingers, the longitudinal body of the clamp plate having an end contacting the one or more clamping fingers which are moved for securing the tool between the fingers and a stationary wall of the housing, movement of the one or more clamping fingers corresponding to movement of the clamp plate body end which stems from adjustment of the mechanism; and wherein one or more components of the clamp assembly are contained within the housing and operably coupled between the mechanism the clamp plate to limit the adjustment of the mechanism to prevent damage to one or more of tools having different tang styles and the tool holder when securing the tools between the fingers and the housing stationary wall; and wherein the clamp plate has at least two differing tolerance areas provided therein to enable different degrees of freedom or play for the clamp plate body end both in direction of corresponding movement of the end and in crosswise direction when securing a tool via the clamp assembly.

12. The tool holder of claim 11 wherein a first tolerance area is defined across the extent of the clamp body end and a second tolerance area is defined across a depth of the clamp body end.

13. The tool holder of claim 12 wherein the extent of the clamp body is crosswise to the corresponding movements of the clamp plate end and the one or more clamping fingers such that the first tolerance area provides tolerance crosswise to such corresponding movements, and whereas the second tolerance area provides tolerance in direction of such corresponding movements.

14. The tool holder of claim 12 wherein the first tolerance area comprises a plurality of first slits defined across the extent of the clamp body end and thereby form a plurality of clamp plate portions in contact with the one or more clamping fingers, wherein the first and second tolerance areas collectively provide complementary tolerances to the one or more clamping fingers when securing a tool between the fingers and the stationary wall of the housing.

15. The tool holder of claim 14 wherein the second tolerance area comprises a plurality of second slits each defined at a depth within corresponding of the clamp plate portions, wherein the slits of the first plurality are defined to extend in crosswise orientation to the slits of the second plurality.

16. The tool holder of claim 14 wherein the second tolerance area comprises shape memory material provided on each of the clamp plate portions at points of contact with the one or more clamping portions.

17. The tool holder of claim 11 wherein the mechanism is an arm having an end operably coupled to the components, wherein the predetermined range of adjustment is a range of rotation of the arm relative to the housing, wherein the range of rotation of the arm is limited to no more than 180°.

18. The tool holder of claim 17 wherein the arm end is rotatably joined to a clamping nut of the clamping assembly, the clamping nut defined with a channel extending about a portion of its circumference and within which a pin rigidly held within the housing projects, wherein rotation of the clamping nut via the arm and relative to the pin results in corresponding movement of the clamp plate.

19. The tool holder of claim 18 wherein points along an extent of the channel correspond to movements of the clamp plate and the one or more clamping fingers for securing different tang styles loaded between the fingers and the stationary wall of the housing.

20. The tool holder of claim 17 wherein the arm is rotatably joined to a cam of the clamping assembly, the cam being held within a cam cartridge, wherein rotation of cam via the arm and relative to the cam cartridge results in corresponding movement of the clamp plate via operable linkage to the cam cartridge.

21. The tool holder of claim 20 wherein the cam cartridge is positioned in advance of cam rotation based on intended tang style to be loaded between the fingers and the stationary wall of the housing, wherein movement of the cam via the arm and relative to the cam cartridge results in movement of the clamp plate and the one or more clamping fingers corresponding to the intended tang style.

22. The tool holder of claim 11 wherein the mechanism comprises a screw head, wherein the predetermined range of adjustment is a range of rotation of the screw head up to a maximum torque being applied to the head.

23. The tool holder of claim 22 wherein the screw head is selectively engaged with an internal clutch of the clamping assembly, the internal clutch including a clutch pin which engages the internal clutch to the screw head up to the maximum torque being applied to the head during adjustment, wherein rotation of the internal clutch via rotation of the screw head up to the maximum torque results in corresponding movements of the clamp plate and the one or more clamping fingers for securing different tang styles loaded between the fingers and the stationary wall of the housing.

24. The tool holder of claim 23 wherein upon the fingers securing any of the differing tang styles, further rotation of the screw head results in the maximum torque being reached and corresponding collapse of clutch pin, with disengagement of the internal clutch from the screw head.

25. The tool holder of claim 22 wherein the screw head is selectively engaged with a clutch plate of the clamping assembly in a pocket defined within housing, the clutch plate including plurality of teeth that are biased toward corresponding recesses of the screw head up to the maximum torque being applied to the head during adjustment based on clutch spring held between the clutch plate and wall of the pocket, wherein rotation of the clutch plate via rotation of the screw head up to the maximum torque results in corresponding movements of the clamp plate and the one or more clamping fingers for securing different tang styles loaded between the fingers and the stationary wall of the housing.

26. The tool holder of claim 25 wherein upon the fingers securing any of the differing tang styles, further rotation of the bolt head results in the maximum torque being reached and corresponding collapse of the clutch spring in the pocket, with disengagement of the clutch plate from the screw head.

27. A tool holder comprising:

a housing;

a mechanism that is mechanically actuatable, the mechanism accessible through an opening defined in the housing; and a clamp assembly operably coupled to the mechanism and comprising:

a clamp plate; and one or more clamping fingers;

wherein the clamp plate is defined as a longitudinal body that has an extent spanning across the one or more clamping fingers, the longitudinal body of the clamp plate having an end contacting the one or more clamping fingers which are moved for securing the tool between the fingers and a stationary wall of the housing, movement of the one or more clamping fingers corresponding to movement of the clamp plate body end which stems from adjustment of the mechanism;

wherein the clamp plate has at least two differing tolerance areas provided therein to enable different degrees of freedom or play for the clamp plate body end both in direction of corresponding movement of the end and in crosswise direction when securing a tool via the clamp assembly, a first tolerance area comprising a plurality of first slits each defined across the extent of the clamp plate body end and thereby forming a plurality of clamp plate portions in contact with the one or more clamping fingers and a second tolerance area each defined across a depth of each of the clamp plate portions, the first and second tolerance areas collectively providing complementary tolerances to the one or more clamping fingers via the clamp plate when securing the tool between the fingers and the stationary wall of the housing.

28. The tool holder of claim 27 wherein the extent of the clamp body is crosswise to the corresponding movements of the clamp plate end and the one or more clamping fingers such that the slits of the first plurality provide tolerance crosswise to such corresponding movements, and whereas the second tolerance area provides tolerance in direction of such corresponding movements.

29. The tool holder of claim 28 wherein the second tolerance area comprises a plurality of second slits each defined at a depth within corresponding of the clamp plate portions.

30. The tool holder of claim 29 wherein the slits of the first plurality are defined to extend in crosswise orientation to the slits of the second plurality.

31. The tool holder of claim 28 wherein the second tolerance area comprises shape memory material provided on each of the clamp plate portions at points of contact with the one or more clamping portions.

32. The tool holder of claim 27 wherein the tool holder is configured for use with tools having different tang styles, wherein one or more components of the clamp assembly are contained within the housing and operably coupled between the mechanism the clamp plate to limit the adjustment of the mechanism to prevent damage to one or more of tools having different tang styles and the tool holder when securing the tools between the fingers and the housing stationary wall.

* * * * *